US011078667B2

(12) United States Patent
Kelly

(10) Patent No.: US 11,078,667 B2
(45) Date of Patent: Aug. 3, 2021

(54) EXTENDABLE BEAM WITH SLOTS

(71) Applicant: Quick Headers, LLC, Ogden, UT (US)

(72) Inventor: Scot Ryan Kelly, Huntsville, UT (US)

(73) Assignee: Quick Headers, LLC, Ogden, UT (US)

( * ) Notice: Subject to any disclaimer, the term of this patent is extended or adjusted under 35 U.S.C. 154(b) by 0 days.

(21) Appl. No.: 16/433,800

(22) Filed: Jun. 6, 2019

(65) Prior Publication Data

US 2020/0385988 A1 Dec. 10, 2020

(51) Int. Cl.

| | |
|---|---|
| ***E04C 3/07*** | (2006.01) |
| ***E04C 3/02*** | (2006.01) |
| ***E04B 2/02*** | (2006.01) |
| ***E04C 3/04*** | (2006.01) |
| ***E06B 1/02*** | (2006.01) |

(52) U.S. Cl.

CPC ..... *E04C 3/07* (2013.01); *E04B 2/02* (2013.01); *E04C 2003/023* (2013.01); *E04C 2003/0413* (2013.01); *E04C 2003/0473* (2013.01); *E06B 1/02* (2013.01)

(58) Field of Classification Search

CPC ..... E04C 3/005; E04C 3/07; E04C 2003/023
See application file for complete search history.

(56) References Cited

U.S. PATENT DOCUMENTS 2,949,656 A * 8/1960 Klaus ..... E04C 3/02 249/19
4,121,804 A * 10/1978 O'Leary ..... B28B 7/0017 249/157
5,459,967 A * 10/1995 Bodtker ..... E04B 7/00 182/82
7,546,718 B2 * 6/2009 Vasta ..... E04C 3/005 52/118
8,261,509 B2 * 9/2012 Harkin ..... E04G 23/0237 52/645
2002/0074915 A1 * 6/2002 Shih ..... H05K 7/1489 312/334.5
2006/0010809 A1 * 1/2006 Lafreniere ..... E04B 2/766 52/489.1
2017/0073970 A1 * 3/2017 Weber ..... E06B 1/14

FOREIGN PATENT DOCUMENTS

| | | | | |
|---|---|---|---|---|
| DE | 840435 C | * | 6/1952 | ..... E04G 11/56 |
| DE | 29516293 U1 | * | 12/1995 | ..... E04G 11/54 |
| GB | 855048 A | * | 11/1960 | ..... E04G 11/56 |
| GB | 2481908 A | * | 1/2012 | ..... E04B 5/12 |

* cited by examiner

*Primary Examiner* — Christine T Cajilig
(74) *Attorney, Agent, or Firm* — Dentons Durham Jones Pinegar

(57) ABSTRACT

A system for traversing an opening of a construction element the system including a elongated housing with two extendable elements configured to reside at least partially within the housing. The extendable elements may extend beyond the housing and may include flanges or ledges which may engage the ends of a construction element, which may be a wall, and thus allow the system to traverse the opening of a construction element, such as a window or door. The system may allow a user to easily manipulate the system to fit a plurality of openings and reuse the system a countless number of times.

19 Claims, 16 Drawing Sheets

210
31
152
118
162
128
112
118'
38
162
120
120'
32
34
40
42
44

210
162
38
126
152
128
125
152
124
162
32
32
42
44
40

210
112
118
128
116
118'

EXTENDABLE BEAM WITH SLOTS

CROSS-REFERENCE TO RELATED APPLICATIONS

This application incorporates by reference U.S. patent application Ser. No. 15/672,143 entitled EXTENDABLE BEAM filed Aug. 8, 2017, now U.S. Pat. No. 10,280,618.

TECHNICAL FIELD

This disclosure relates generally to an extendable beam methods and systems for masonry use in spanning and carrying a load of an opening. These systems relate more specifically to the use of a single beam over two vertical supports to create an opening, such as a window or doorway or other architectural element.

RELATED ART

In masonry, forms are often used to create windows, doorways or openings. These forms can be called many different things such as frames, bucks, headers, girders, joists and the like. These forms are often made of simple wood (2×4s or 2×6s) and built to hopefully fit within the space needed. Many times the wood frames are not the right size and have to be cut, fit, worked and reworked until the proper dimensions of the frame is made. After the frame is constructed then a mason or other construction worker may begin building the next layer of block over the frame, maintaining the opening.

These frames are costly and are typically limited to a one time, single use because of the opening size. Often installation and removal these frames require block repair and in interrupts a mason's job. A wood frame may also leave rough finishings and limit access through the opening while the frame is in place and are not considered a very environmentally sensitive (or "green") practice.

Other devices include lintels. These lintels are supported by other support beams made of wood or metal that extends from the base of an opening to the lintel. These lintels may also include a single extendable portion that slides from a single side of the lintel so that the lintel may be used for different size openings. In one instance a lintel may include a first fixed shoulder that sits on one wall then a second extendable shoulder that sits on a different wall. The lintel rests on the two walls over an opening. These devices are only intended to telescope from a single side and may allow the lintel to nearly double its size.

SUMMARY

This disclosure, at least in one aspect, relates to a system or device with a longitudinal housing, which may be comprised of steel, or steel alloy, or other metal, or strong structure capable of holding significant weight (i.e. carbon fiber). The housing may be elongated with a U-shaped or C-shaped cross-section. The housing may hold, or may be capable of encompassing at least one extendable member. The at least one extendable member may be two extendable members that each extend from the housing in opposite directions.

The housing may be forged, bent, milled, extruded or the like from a single piece of metal and may be forged with multiple bends (which bends may be 90°). The housing may also be welded with multiple pieces of metal at 90° angles or bends (or nearly 90° angels or bends) as well. The housing may include a first longitudinal wall that extends the length of the housing, a pair of second longitudinal walls that may be perpendicular to the first longitudinal wall and extend the length of the housing. A pair of third longitudinal walls, or pair of lips, that may be perpendicular to the pair of second longitudinal walls. The pair of lips may extend at least partially toward a longitudinal axis of the housing and the pair of lips may be parallel or close to parallel to the first longitudinal wall. At least one cross support post may extend between the pair of lips across a void in the housing securing the one lip to the second lip. The cross support post may be welded, forged or the like.

The system may comprise multiple configurations. In a first configuration the two extendable members may reside entirely within the housing. The two extendable members may be held within the housing by the pair of lips of the housing. Alternatively the two extendable members may be held by at least one support member which may be welded inside the housing. The at least one support member may be a plurality of support members. The plurality of support members may be secured, welded, formed, etc. to the pair of second longitudinal walls. The plurality of support members may be positioned opposite one another on the pair of second longitudinal walls. The plurality of support members may extend longitudinally at least partially along the pair of second longitudinal walls.

Alternatively, a separate retention element may be used to maintain the two extendable members. For instance, an apertures may be milled. or premanufactured, o drilled into lateral, or side, walls of the housing and allow for passage of a pin or rod. A slot may also be milled, ore premanufactured, into the side walls of the extendable members. Such slots may allow for extension of the extendable members within a range to prevent the complete withdrawal of the extension member from the housing.

The extendable members may be similar in shape and size and may be interchangeable. The extendable members may be forged or welded and are separate from the housing. The extendable members may be substantially rectangular in shape and from one perspective may resemble a tray or open top box. Each extendable member may comprise a longitudinal axis, a first wall, a pair of second walls opposite each other, which may be parallel to each other, extending from the first wall at a 90° angle, and a pair of third walls opposite each other, and which may be parallel to each other, extending from the first wall at a 90° angle and connected to the pair of second walls.

The pair of second walls may be different lengths extending from the first wall. The distal wall of the pair of second walls, may be shorter in length than the proximal wall. The proximal wall may be longer and may engage the plurality of support members of the housing to act as a stop such that the extendable members may not extend out of the housing beyond a predetermined or predesignated distance or amount. An extendable member flange, or tab, may extend distally from the distal wall of the pair of second walls. The extendable flange may be configured to engage a wall or support for the system to rest on.

The pair of third walls may be substantially parallel and may be substantially the same length and width. The pair of third walls may provide a slide or guide to glide along the plurality of support members while the extendable members are manipulated at different positions relative to the housing.

A second configuration may be both extendable members extending beyond the housing exposing each flange of each extendable member to engage the construction element, walls or supports, that traverses an opening of the construction element. In a third configuration at least one of the extendable members may extend at least partially beyond the housing, exposing at least one flange from the extendable member to engage a wall or support of the construction while the other extendable member only protrudes from the housing far enough to expose a flange to engage the construction element.

Additionally, the extendable member may further include variable flanges extending from distal ends of the extendable members. Different angles of flanges with different depths are considered and may be utilized for different angles of intersecting walls.

The system may comprise or resemble a lintel or header and may be configured to traverse an opening of a structure, such as a door or window for a building that is being constructed.

DETAILED DESCRIPTION

Figure 1:
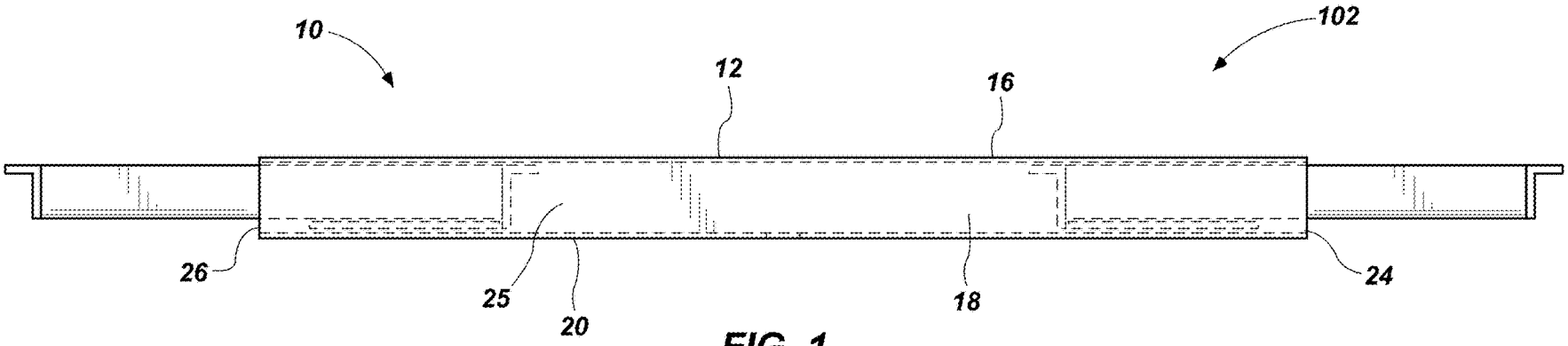
FIG. 1 illustrates a side view a system in a second configuration with a housing and two extendable members extended from the housing.
Figure 2:
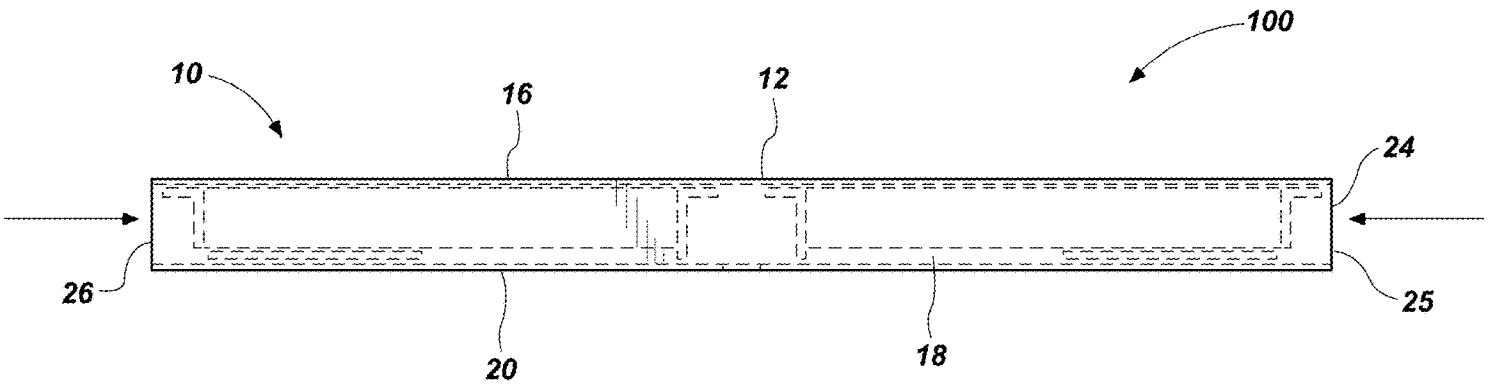
FIG. 2 illustrates a side view of the system of FIG. 1 in a first configuration with the two extendable members retracted within the housing.

FIGS. 1 and 2 illustrate at least one embodiment of device or system 10 which may be a horizontal support member, a lintel, a beam or the like. In the industry these systems may be referred to as "bucks" or "headers." Other references to the system 10 may be a "frame" as well. The system 10 may include a housing 12 which may be a single piece of metal, often steel, that is forged into a U-shaped or C-shaped configuration. The housing 12 may be manipulated with bends in the housing for optimum use by a mason (for purposes of this disclosure a "mason" may be a construction worker, mason, brick layer, stone layer, block layer or similar). The housing 12 may be a longitudinal member which may be substantially rectangular in shape from a plurality of views. A longitudinal axis 14 may extend the length of the housing.

The housing 12 may include a first wall 16, which may be substantially planar, extending a length and a width of the housing 12. The first wall 16 may be substantially flat and configured to allow other flat elements (i.e. bricks, blocks, etc.) to easily reside on the first wall 16. The first wall 16 may include bends or curves toward each width end of the first wall 16. A pair of second walls 18, 18' may extend from the first wall 16, or the bends of the first wall 16, in a direction substantially perpendicular to the first wall 16. Extending from the pair of second walls 18, 18' are a pair of third walls 20, 20' that may extend from separate bends in the second walls 18, 18'. The pair of third walls 20, 20' may extend toward each other and the longitudinal axis 14, or midline, of the longitudinal housing 12. A channel 25 may be positioned between the pair of third walls 20, 20' and run the length of the housing 12. The third walls 20, 20' may be substantially parallel to the first wall 16. The channel 25, or passage, or void, may run the length of the housing. A cross-sectional shape of the housing 16 may resemble a C-shape or U-shape.

The housing 12 may include a first opening 24 toward one end of the housing 12 and a second opening 26 toward a second end of the housing 12 with the channel running from the first opening 24 to the second opening 26.

The housing may be comprised of a single piece of metal or steel and may be forged of a single piece of metal. The single piece of metal is forged with the bends in the walls as described earlier and allows for greater strength of the housing rather than welding the walls together at weld points. However, it will be appreciated that the system 12 may be welded together with multiple metal pieces. In the instance of welding the "bends" may be sharper and more defined and not as curved, or the welds may be ground or sanded down to form similar bends as though the housing 12 was forged from a single piece of metal.

Figure 3:
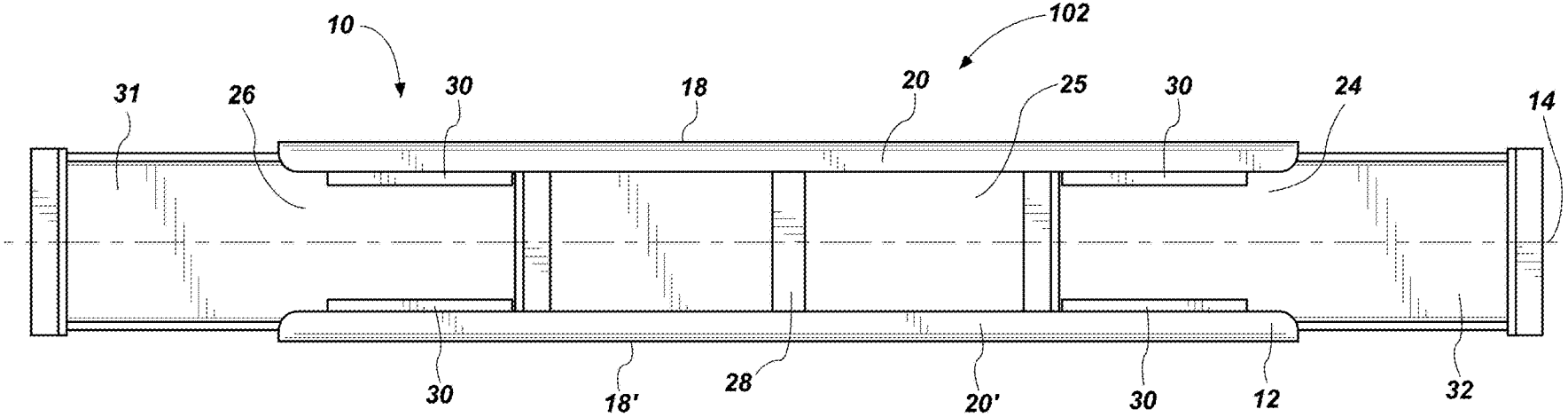
FIG. 3 illustrates a bottom view of the system of FIG. 1 with a first extendable member and a second extendable member in the second configuration.
Figure 4:
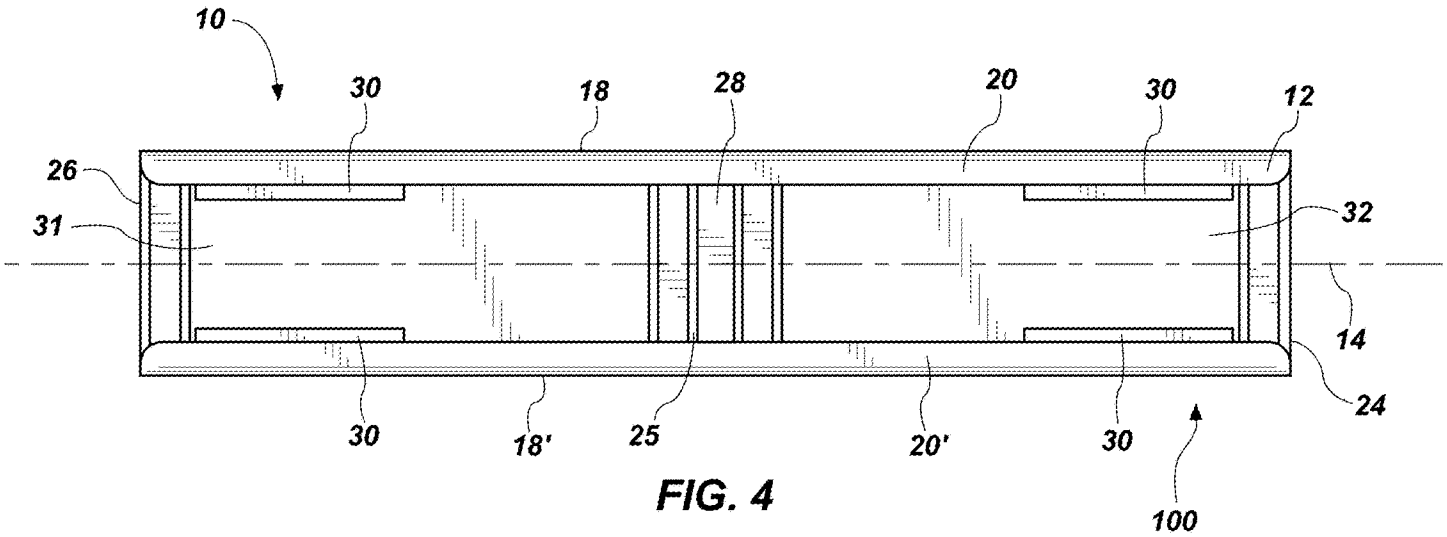
FIG. 4 illustrates a bottom perspective view of the system of FIG. 1 with a first extendable member and a second extendable member in the first configuration.

Referring to FIGS. 3 and 4, a cross-bar 28 may extend from the third walls 20, 20' across the channel 25. The cross-bar 28 may provide greater structural integrity to the device 10 and specifically the housing 12 to maintain the housing shape and to allow the device 10 to carry heavier loads. More than one cross-bar 28 may be utilized and may be commensurate with a ratio of the length of the housing 12 and may be the cross-bar(s) 28 positioned depending on length of the housing 12.

A plurality of support members 30 may be positioned and secured to the housing on the interior of the second walls 18, 18' within the channel 25. Securing of the support members 30 may be accomplished by welding the pieces into place. The plurality of support members 30 may be positioned opposite one another on the pair of second walls 18, 18' and at multiple locations along the pair of second walls 18, 18'. For example, support members 30 may be secured at different longitudinal positions along the interior of the second walls 18, 18'. The plurality of support members 30 may extend longitudinally at least partially along the pair of second walls 18, 18' and provide additional support and may operate as a guide or track for extendable members. The support members 30 may also be planar, or flat, with the plan of the support members running substantially parallel to the first wall 16 of the housing.

Figure 6:
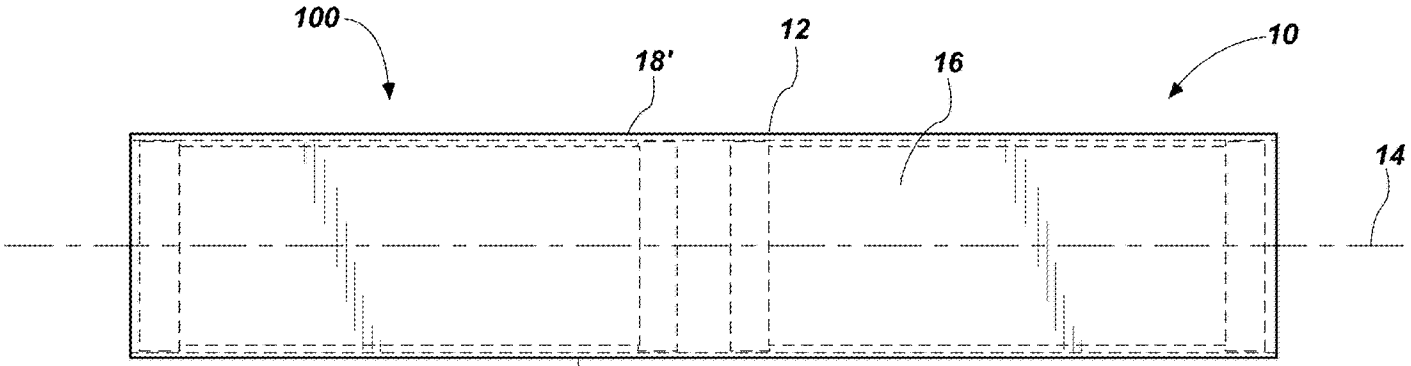
FIG. 6 illustrates a top view of the system of FIG. 1 in the first configuration.

Referring to FIGS. 4 and 6, a first configuration 100 shows a first extendable member 32 and a second extendable member 31 in a retracted position within the channel 25, wherein the first and second extendable members 32, 31 are positioned within the housing 12. The first and second extendable members 32, 31 are configured to slide, longitudinally, within the channel 25 and along the support members 30 and may exit the first and second openings 24, 26, respectively. The first extendable member 32 is configured to reversibly slide away from the second extendable member 31 and vice versa.

Referring to FIG. 3, a second configuration 102 shows the first and second extendable members 32, 31 protruding from and extending from the housing 12. First extendable member 32 extends along the same longitudinal axis as the housing axis 14 and in the opposite direction of the second extendable member 31.

Figure 5:
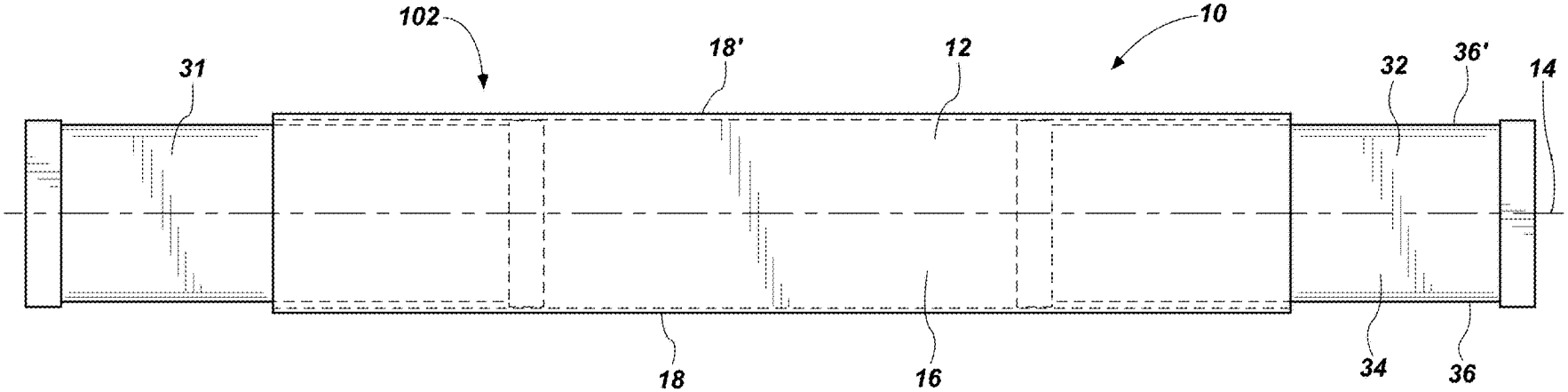
FIG. 5 illustrates a top view of the system of FIG. 1 in the second configuration.

Referring to FIGS. 3 and 5, the first extendable member 32 extends from the housing 12 in a longitudinal direction and along the same longitudinal axis 14 as the housing 12. The first extendable member 32 is configured to fit at least partially within the housing 12 and may fit entirely within the housing 12. The first extendable member 32 includes a body with a planar first wall 34 that may run substantially parallel to the first wall 16 of the housing. On the two lateral sides of the planar first wall, two extendable member second walls 36, 36', opposite each other, may extend from the planar first wall 34 at 90°. The two extendable member second walls 36, 36' may engage the support members 30 with the walls gliding or sliding along the support members 30. Alternatively the two extendable member second walls 36, 36' may engage and glide or slide along the third walls 20, 20' of the housing 12.

Figure 7:
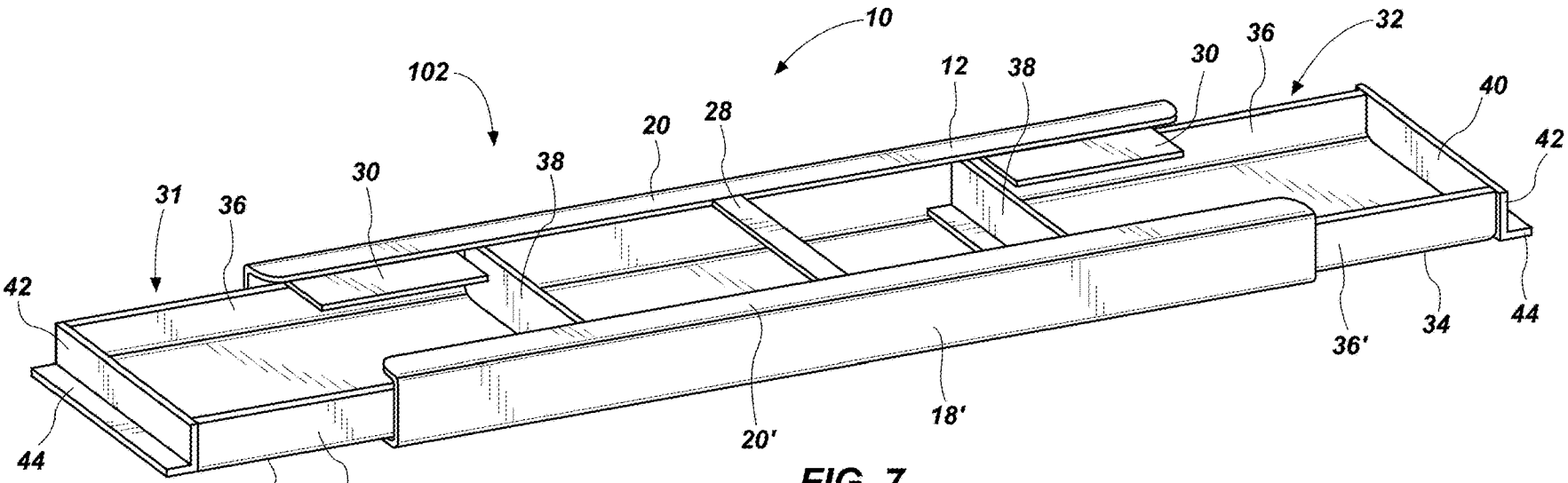
FIG. 7 illustrates a bottom perspective view of the system of FIG. 1 with a first extendable member and a second extendable member in the second configuration.
Figure 8:
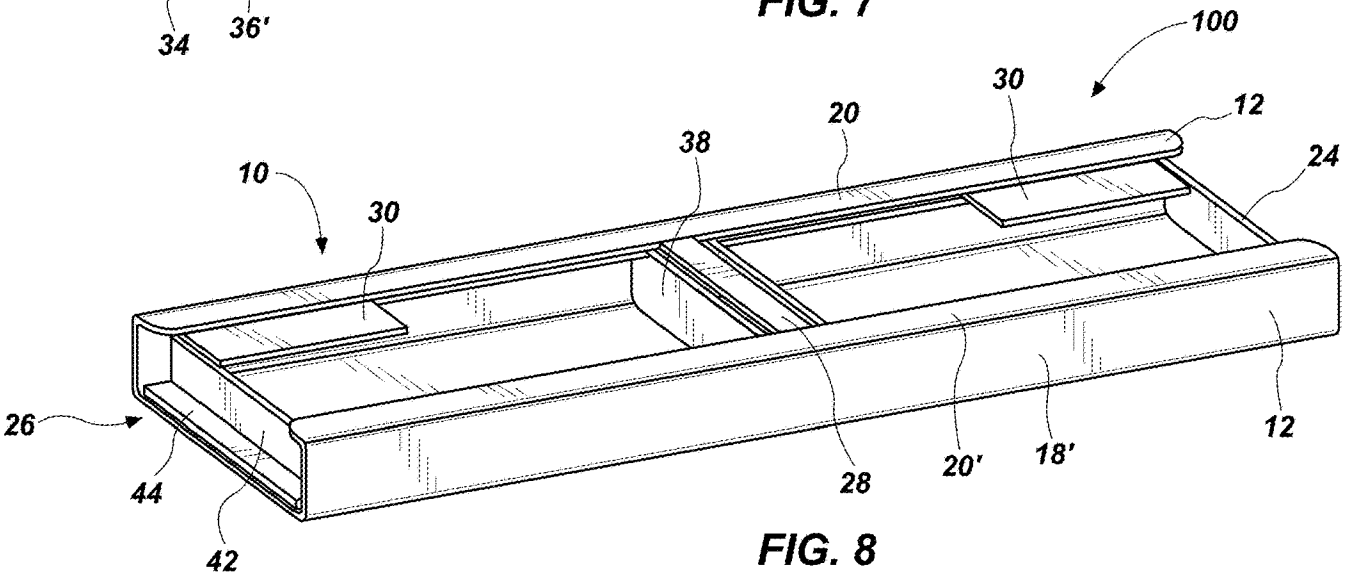
FIG. 8 illustrates a bottom perspective view of the system of FIG. 1 with a first extendable member and a second extendable member in the first configuration.

Referring to FIGS. 7 and 8, the first extendable member 32 may be substantially rectangular in shape and from one perspective may resemble a tray or open top box. The first extendable member 32 may comprise a proximal wall 38 and a distal wall 40, opposite each other, and which may be substantially parallel to each other, extending from the first planar wall 34 at a 90° angle and connected to the pair of extendable member second walls 36, 36'.

The proximal wall 38 may extend further from the planar first wall 34 than the distal wall 40. The proximal wall 38 may extend further than the extendable member second walls 36, 36' as well. The proximal wall 38 may provide a stop against a proximal end of the support members 30, so that the first extendable member 32 does not extend too far out of the housing 12. The distal wall 40 may include a distal tip 42 which may include a flange 44, or tab, which extends longitudinally from the distal wall 40 in the same plane or parallel plane as the planar first wall 34. The distal tip 42 may be integrated into the body of the first extendable member 32 or may be a separate piece that may be secured, or welded, to the distal wall 40. The distal tip 42 may include a right angle piece, or elbow, that on one plane sits flush against the distal wall 40 and a separate plane, perpendicular to the one plane sitting flush against the distal wall, extending in a same plane, or substantially the same plane, or parallel plane to the first planar wall 34, which may be the flange 44. The flange 44 engages a construction element 50, which may be a wall or support, and rests on that construction element which holds up the system 10. Each extendable member 32, 31 may extend from the housing 12 at least as far as half of the length of the extendable members 32, 31. Each extendable member 32, 31 may extend just far enough for the flange 44 to protrude from the housing 12 to engage one edge of an opening (see FIG. 9). Each extendable member 32, 31 may extend as far as required to traverse an opening with the appropriate length of housing 12. The distance each extendable member 32, 31 extends infinite because it can slide to any number of positions from the flange 44 extending until the extendable member 32, 31 hits the stop or the support member 30.

The first extendable member 32 may be manufactured, or forged, from a single metal piece or it may be welded from multiple metal pieces. Additionally the first extendable member 32 may complementary fit within the housing 12 such that the curved edges/corners of the housing 12 between the first wall 16 and the second walls 18, 18' may correspond to similar curvatures in the first extendable member 32 between the planar first wall 34 and the extendable member second walls 36, 36'. This complementary fit may allow for ease in sliding the first extendable member 32 out of the housing 12 as well as retracting the first extendable member 32 back into the housing 12.

The second extendable member 31 may be substantially identical to the first extendable member 32. The same elements are utilized in the second extendable member 31 with the same features other than the second extendable member 31 extends from the opposite side of the housing 12 than the first extendable member 32.

The extendable members 32, 31 may extend from a fraction of one inch to up to 12 inches from the housing 12. The length of the entire system 10 may vary from 1.5 feet (18 inches) up to 42 feet and perhaps even longer. The housing 12 may be the majority of the length while the extendable members 32, 31 remain roughly the same size, regardless of the housing 12 size; however, it is contemplated that the extendable members size 32, 31 may increase proportionately to the housing size.

Depending on the length of the system 10 utilized, for the system to traverse an opening in a construction element, posts, or post shores, or props may be required to engage the system 10 at one or more locations. The posts may engage the system 10 on a bottom side, or within the channel 25 side of the housing 12 at strategic locations in the opening of the construction element 50.

Figure 9:
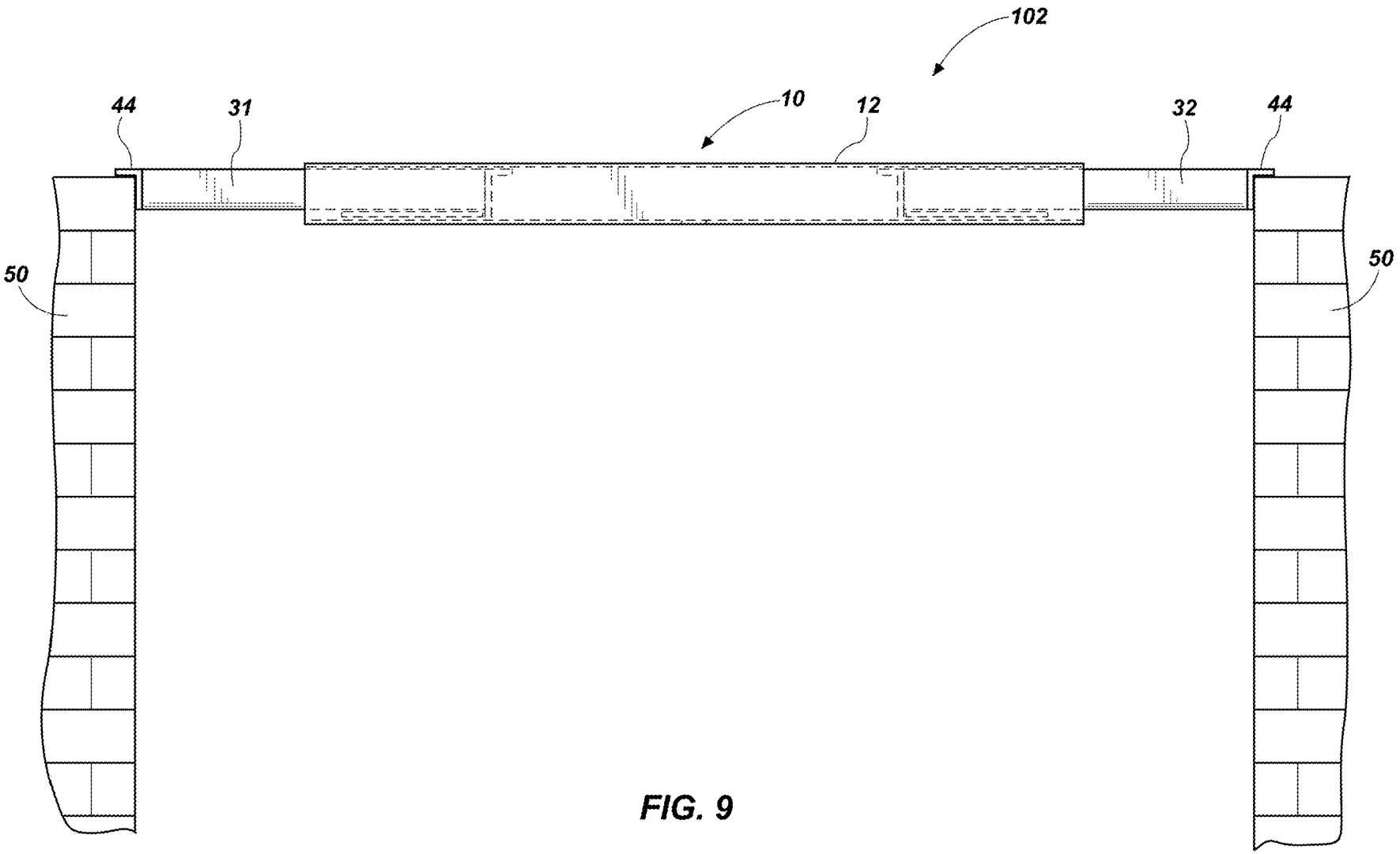
FIG. 9 illustrates the system of FIG. 1 traversing an opening of a construction element.

Referring to FIG. 9, one method of use for the system 10 includes identifying the system 10 (with the extendable members 31, 32 within the housing) that would easily fit within a construction element opening. Extending at least one of the extendable members 31, 32 to expose at least one flange 44 to engage the edge of the opening. Positioning the system across the opening, typically horizontally across the opening, at extending the other of the extendable members 31, 32 to expose the other flange 44 to engage the opposite edge of the same opening.

Figure 10:
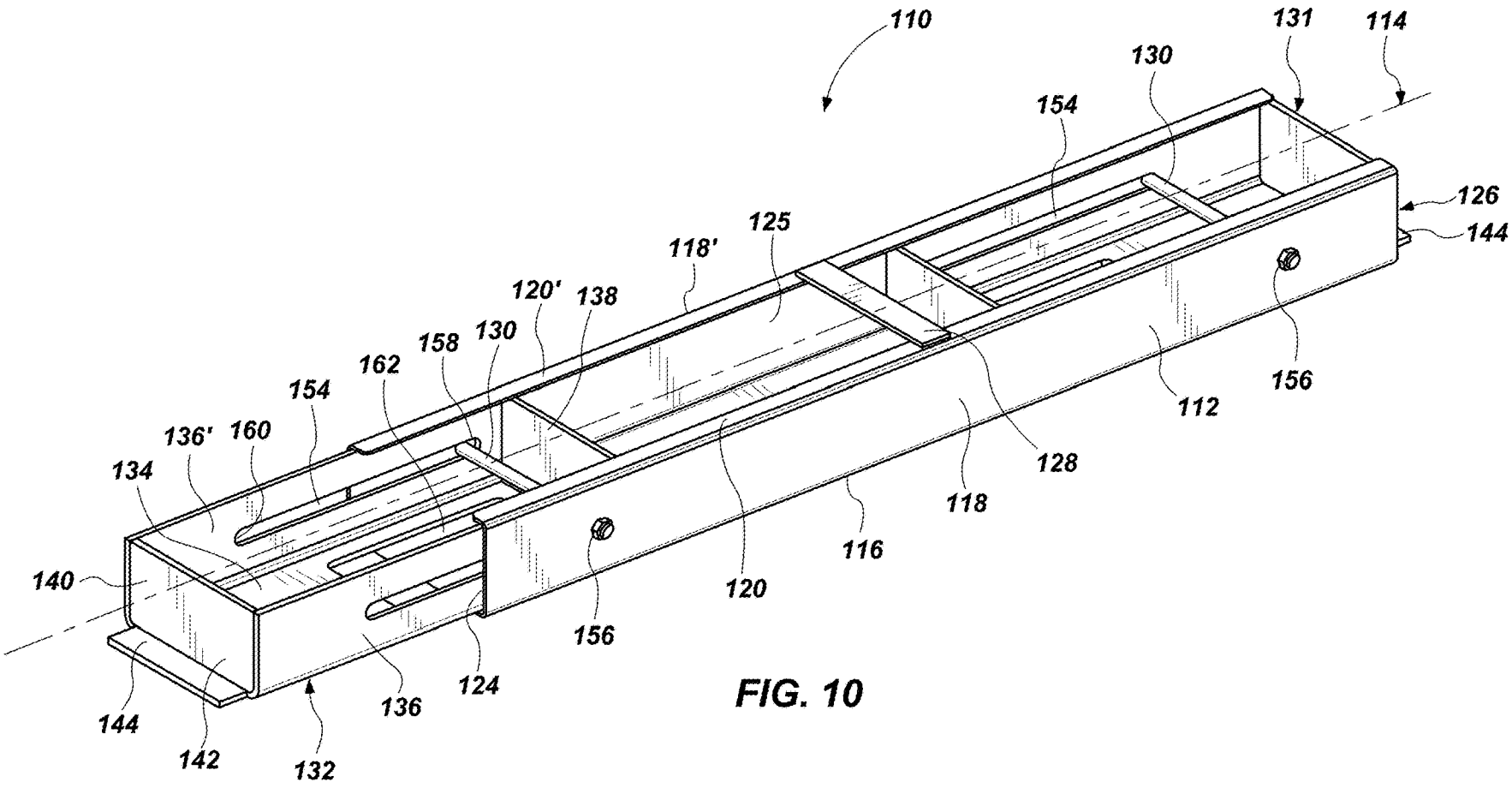
FIG. 10 illustrates a perspective view separate embodiment of the system of FIG. 1 with a pin, extendable members with slots and a window, with one extendable member at least partially extended.
Figures 11, 12, 13:
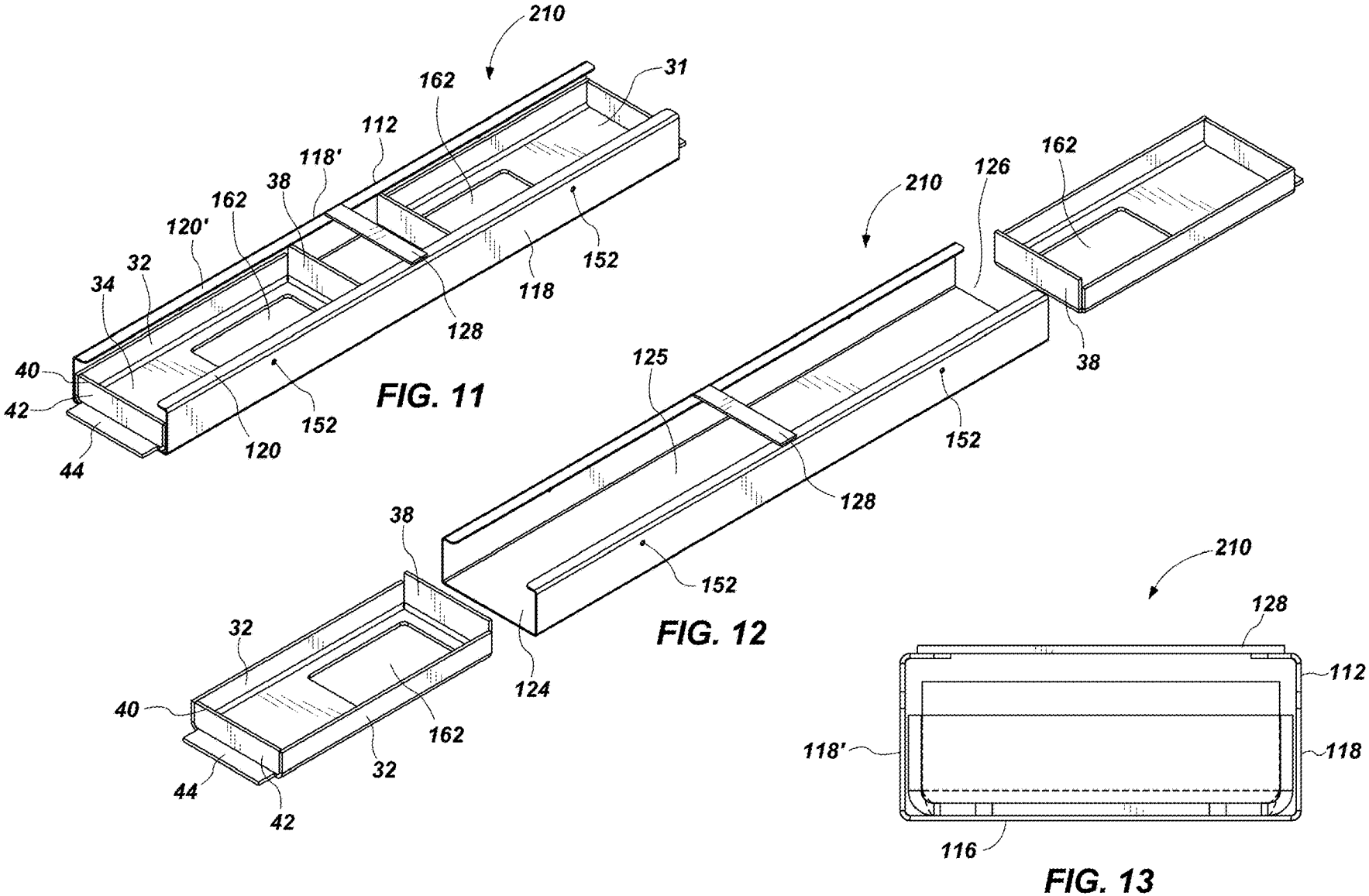
FIG. 11 illustrates a perspective view of the system of FIG. 10 with two extendable members without slots within the housing.
FIG. 12 illustrates a perspective view of the system of FIG. 11 with the extendable members removed from the housing.
FIG. 13 illustrates a side view of the system of FIG. 11.
Figure 14:
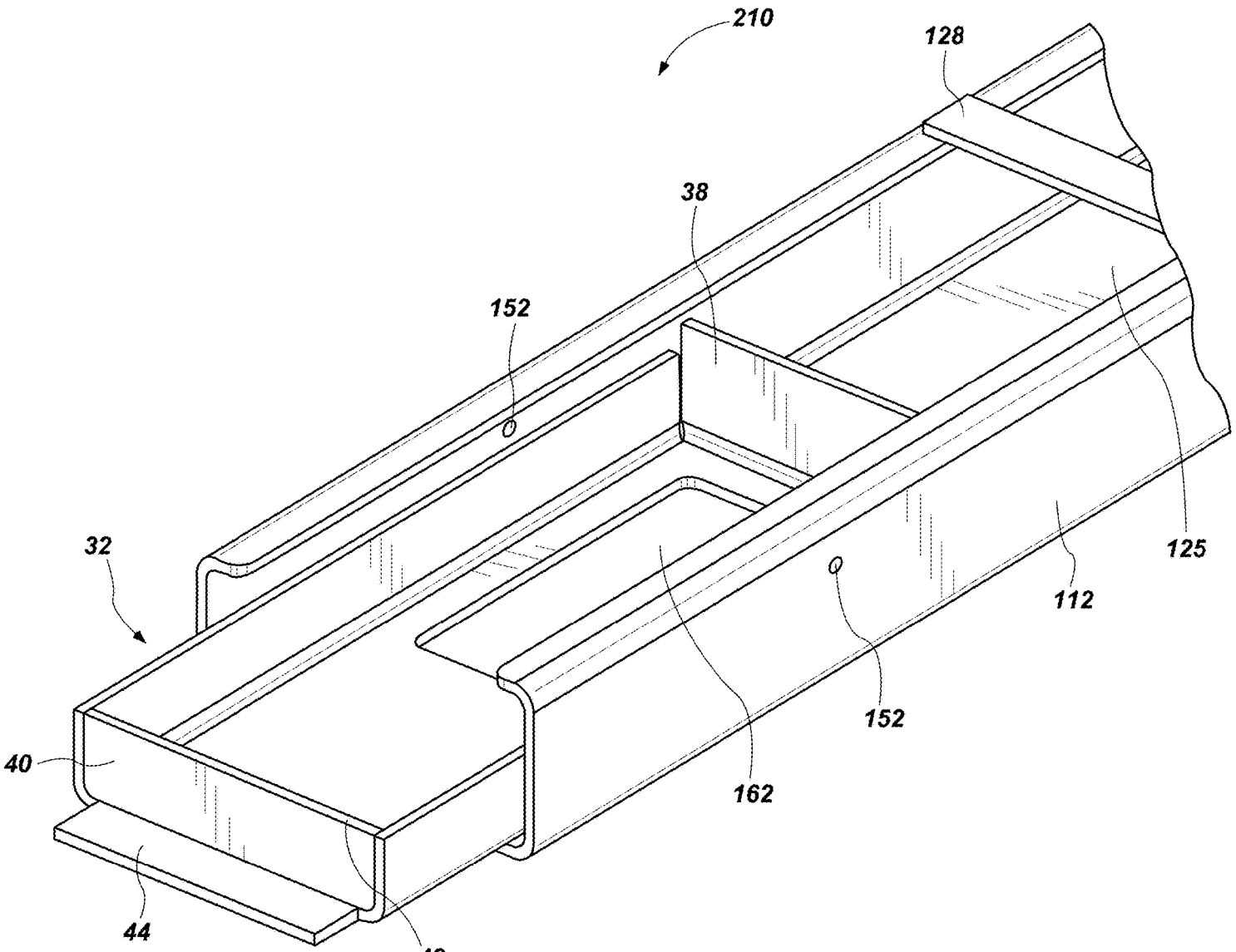
FIG. 14 illustrates a magnified partial perspective view of the system of FIG. 11.
Figure 15:
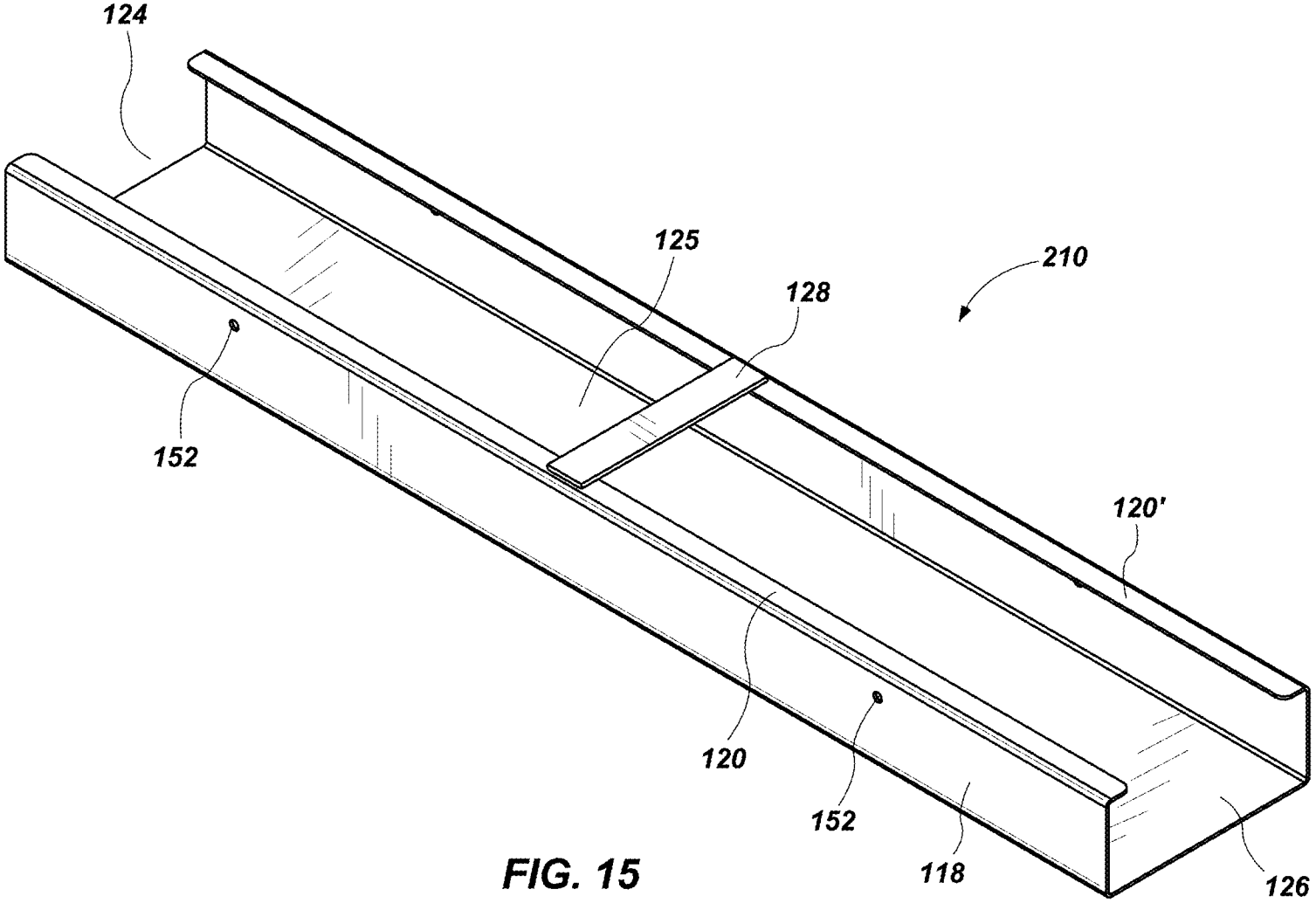
FIG. 15 illustrates a perspective view of the housing of FIG. 10.
Figure 16:
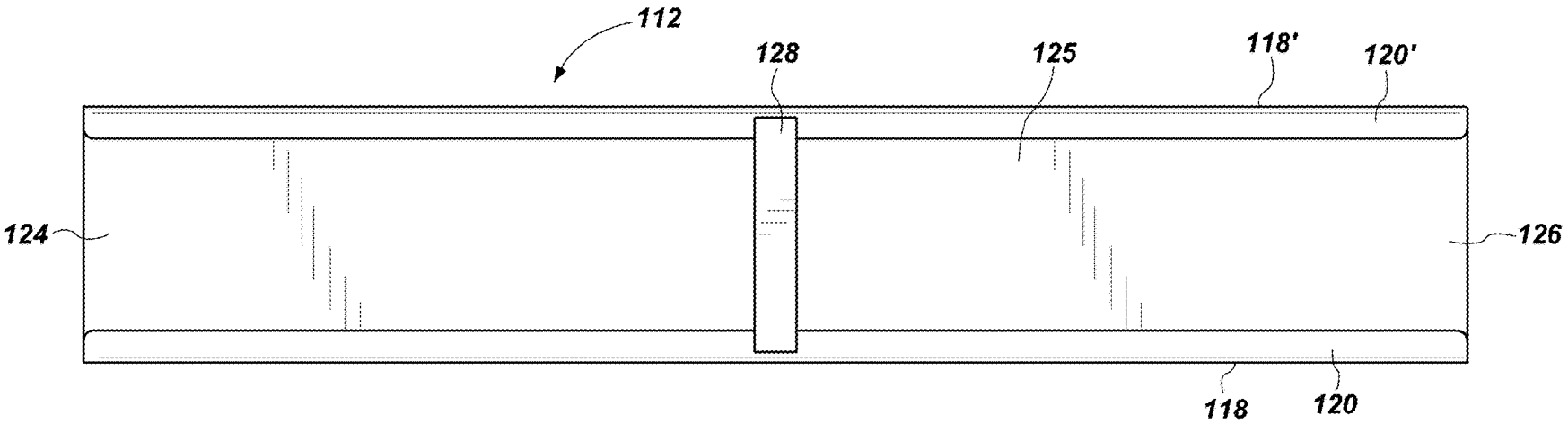
FIG. 16 illustrates a bottom view of the housing of FIG. 10.
Figure 17:
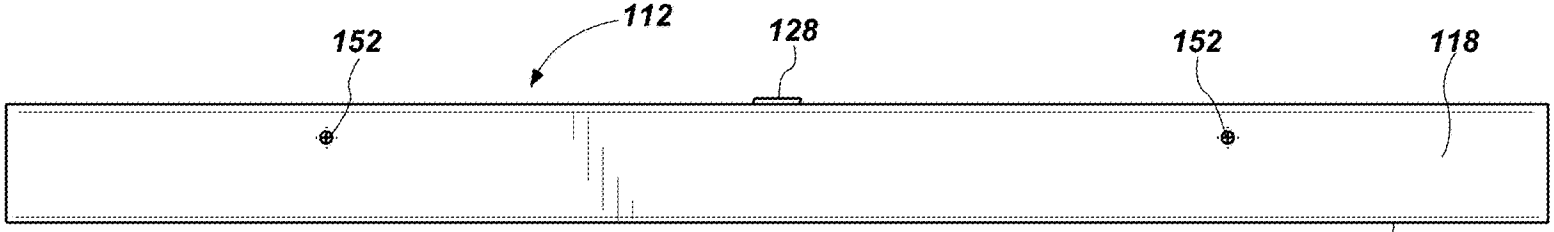
FIG. 17 illustrates a lateral side view of the housing of FIG. 10.
Figure 18:
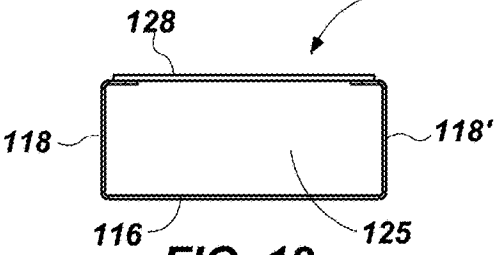
FIG. 18 illustrates a longitudinal side view of the housing of FIG. 10.
Figure 19:
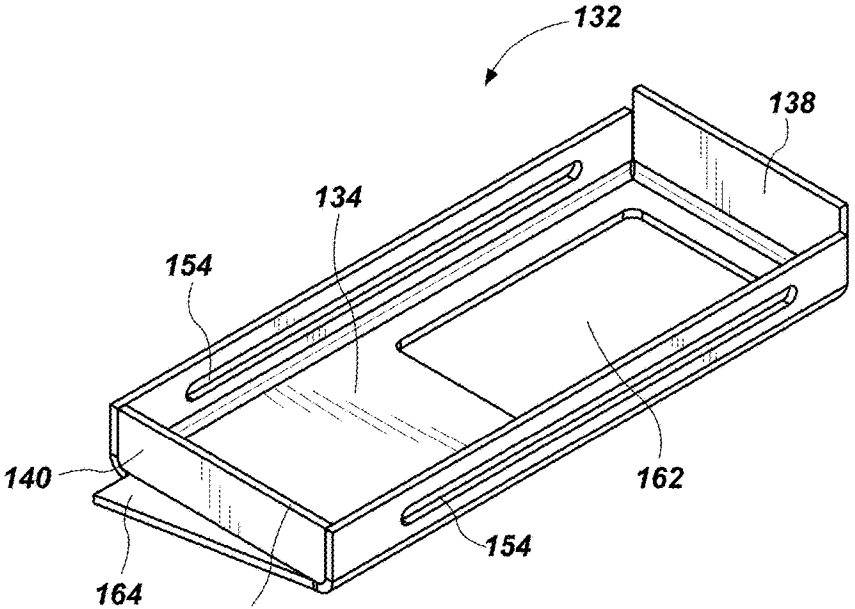
FIG. 19 illustrates a perspective view of an alternate embodiment of an extendable member with slots and an angled flange.
Figure 22:
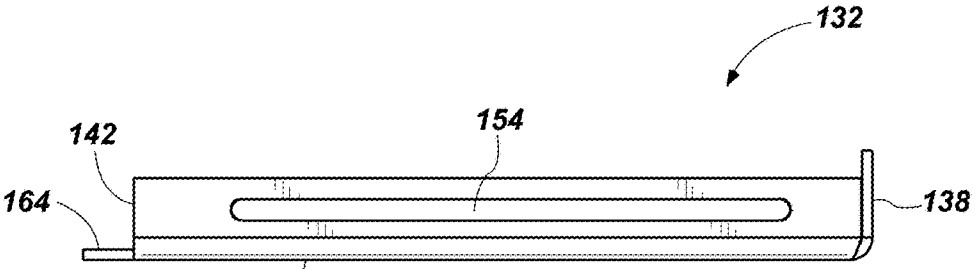
FIG. 22 illustrates a lateral side view of the extendable member of FIG. 19.
Figure 20:
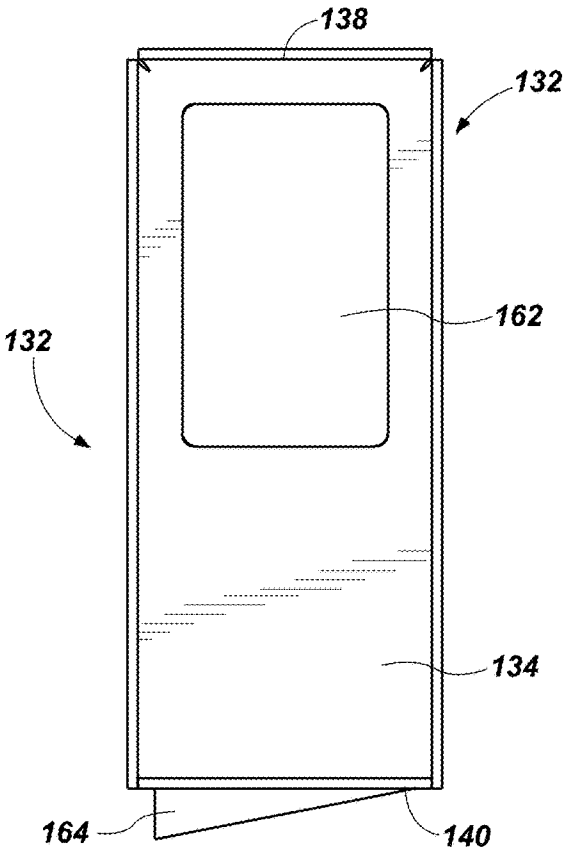
FIG. 20 illustrates a bottom view of the extendable member of FIG. 19.
Figure 21:
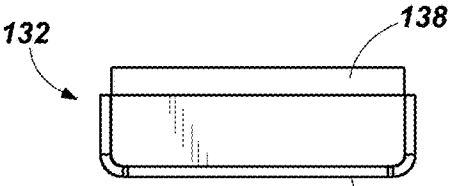
FIG. 21 illustrates a longitudinal side view of the extendable member of FIG. 19.
Figure 23:
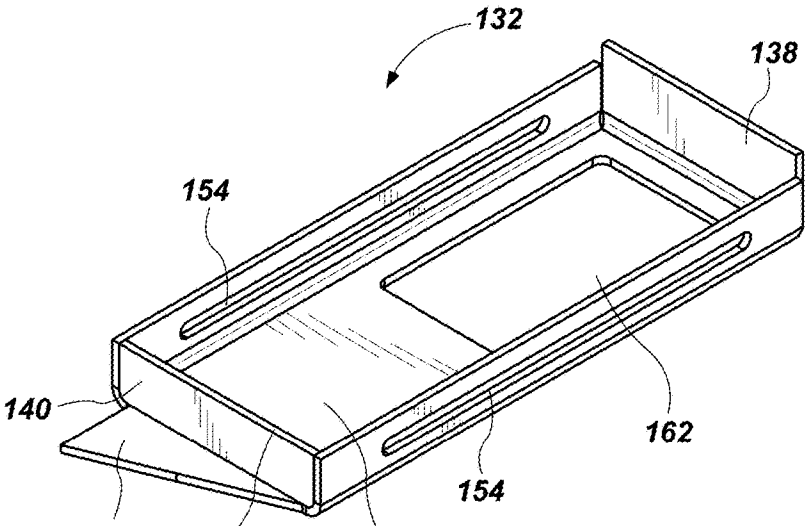
FIG. 23 illustrates a perspective view of an alternate embodiment of an extendable member with slots and with a different angled flange.
Figure 26:
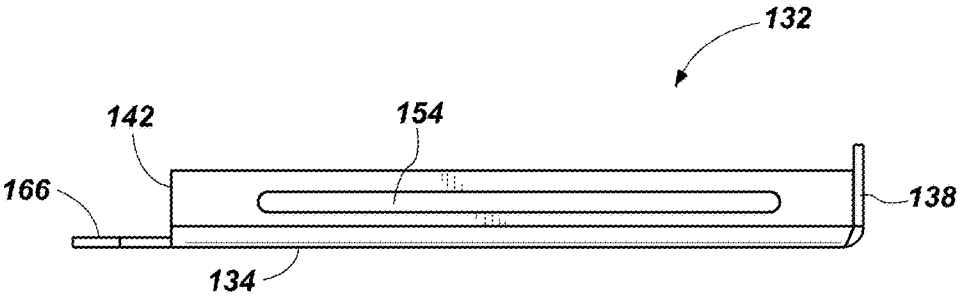
FIG. 26 illustrates a lateral side view of the extendable member of FIG. 23.
Figure 24:
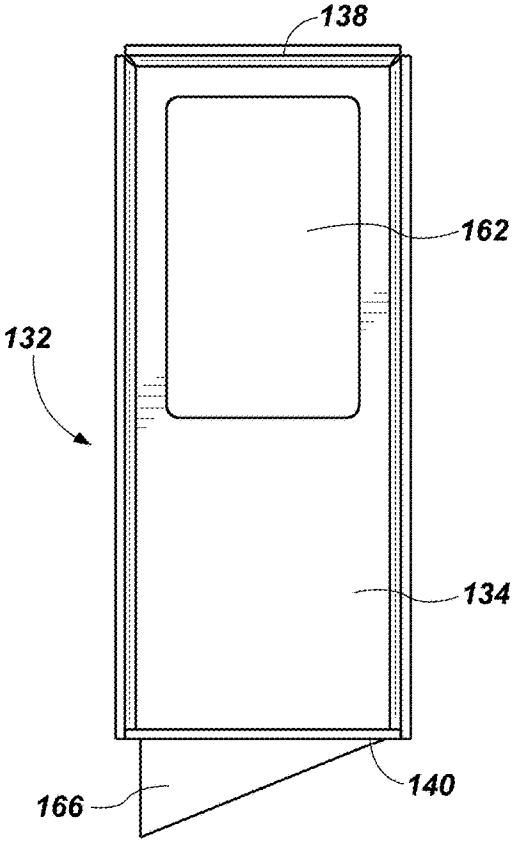
FIG. 24 illustrates a bottom view of the extendable member of FIG. 23.
Figure 25:
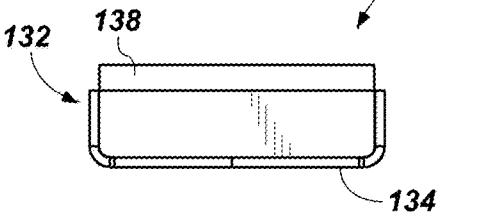
FIG. 25 illustrates a longitudinal side view of the extendable member of FIG. 23.
Figure 27:
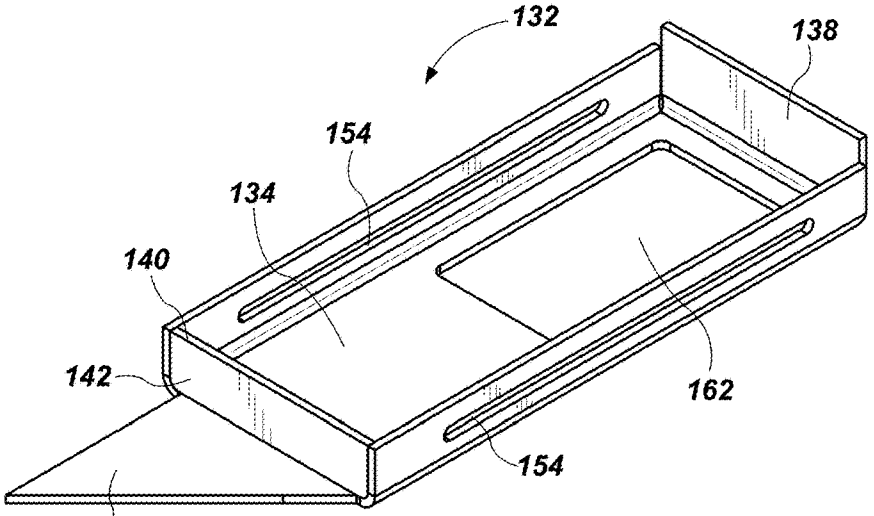
FIG. 27 illustrates a perspective view of an alternate embodiment of an extendable member with slots and with a different angled flange.
Figure 30:
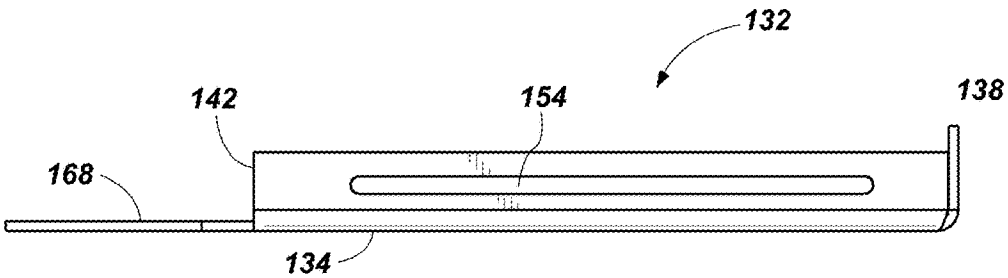
FIG. 30 illustrates a lateral side view of the extendable member of FIG. 27.
Figure 28:
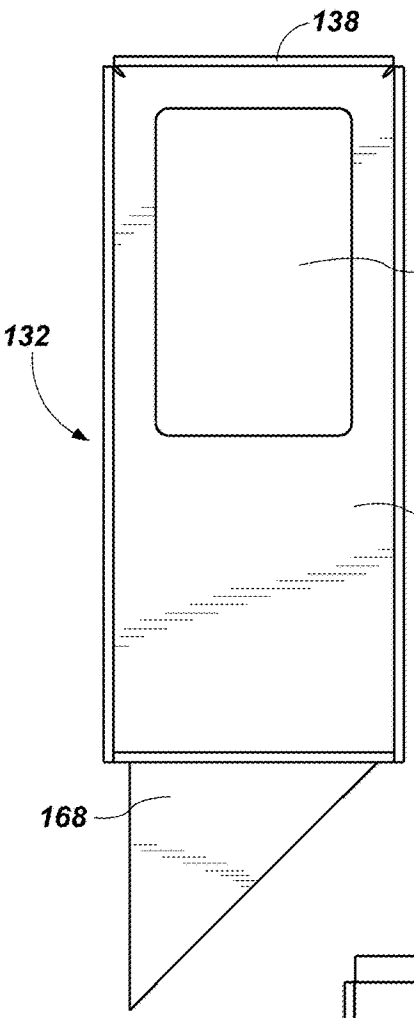
FIG. 28 illustrates a bottom view of the extendable member of FIG. 27.
Figure 29:
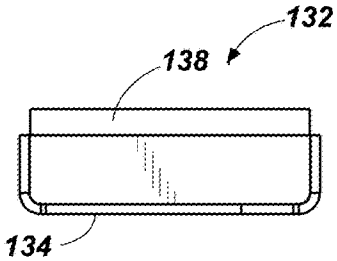
FIG. 29 illustrates a longitudinal side view of the extendable member of FIG. 27.
Figure 31:
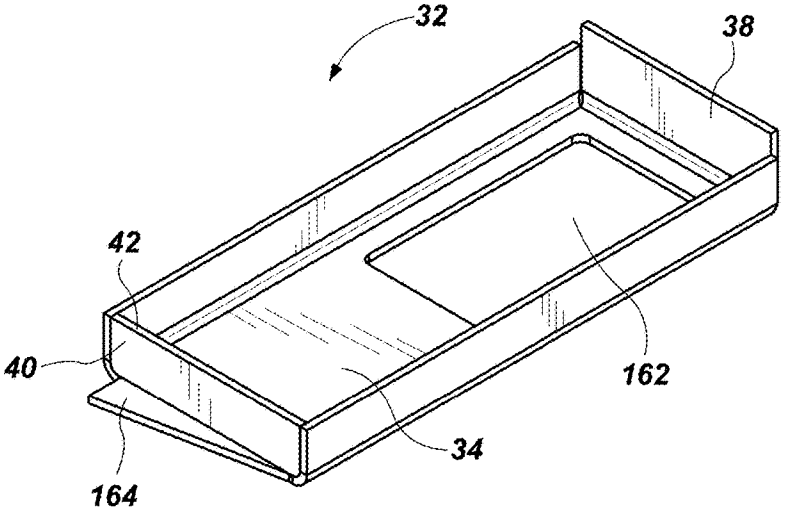
FIG. 31 illustrates a perspective view of an alternate embodiment of an extendable member without slots, but with an angled flange similar to FIG. 19.
Figure 34:
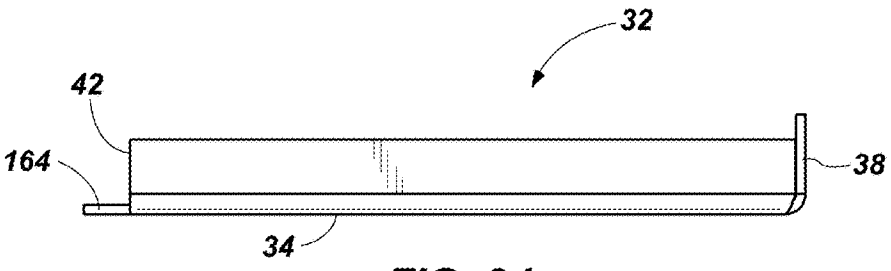
FIG. 34 illustrates a lateral side view of the extendable member of FIG. 31.
Figure 32:
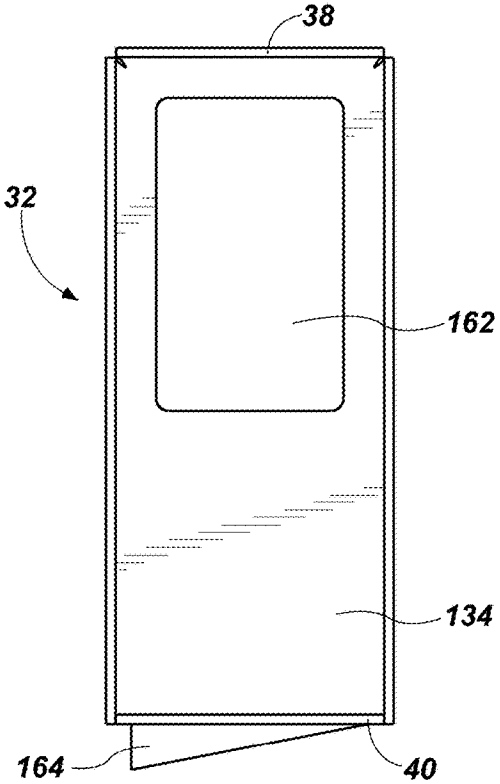
FIG. 32 illustrates a bottom view of the extendable member of FIG. 31.
Figure 33:
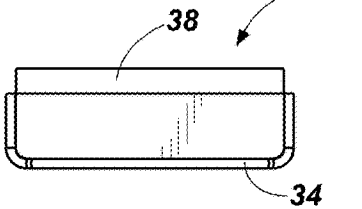
FIG. 33 illustrates a longitudinal side view of the extendable member of FIG. 31.
Figure 35:
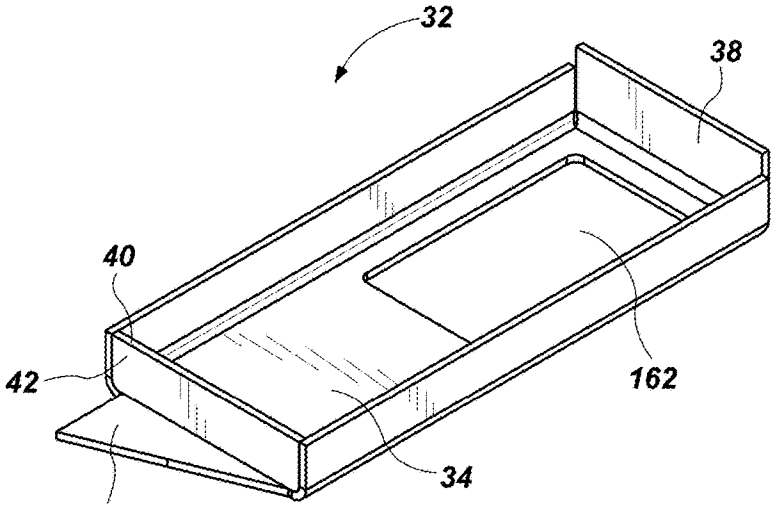
FIG. 35 illustrates a perspective view of an alternate embodiment of an extendable member without slots, but with an angled flange similar to FIG. 23.
Figure 38:
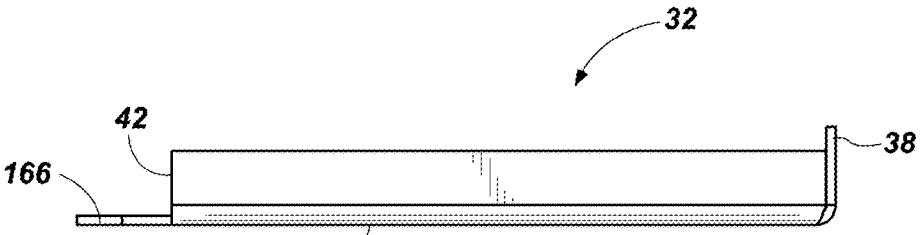
FIG. 38 illustrates a lateral side view of the extendable member of FIG. 35.
Figure 36:
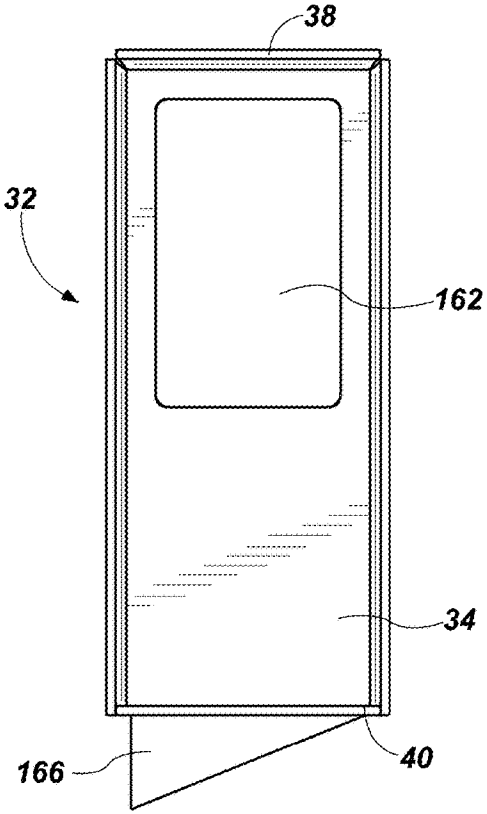
FIG. 36 illustrates a bottom view of the extendable member of FIG. 35.
Figure 37:
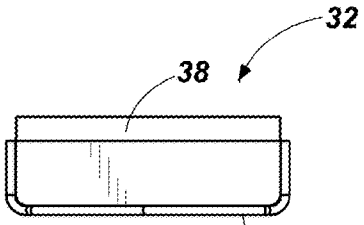
FIG. 37 illustrates a longitudinal side view of the extendable member of FIG. 35.
Figure 39:
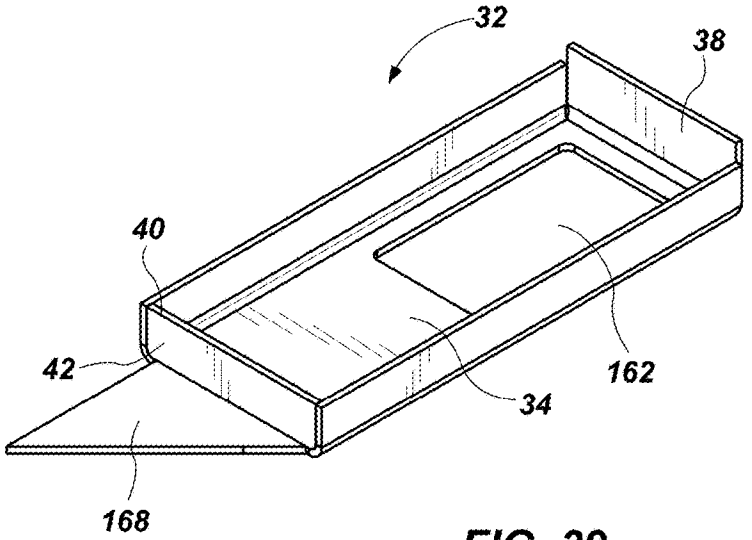
FIG. 39 illustrates a perspective view of an alternate embodiment of an extendable member without slots, but with an angled flange similar to FIG. 27.
Figure 42:
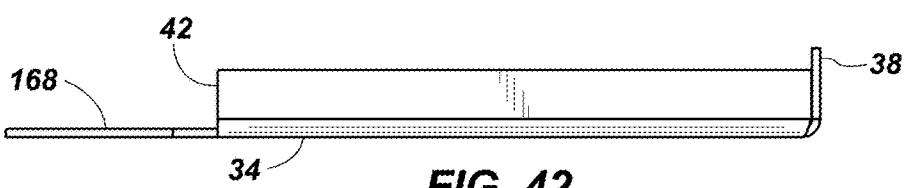
FIG. 42 illustrates a lateral side view of the extendable member of FIG. 39.
Figure 40:
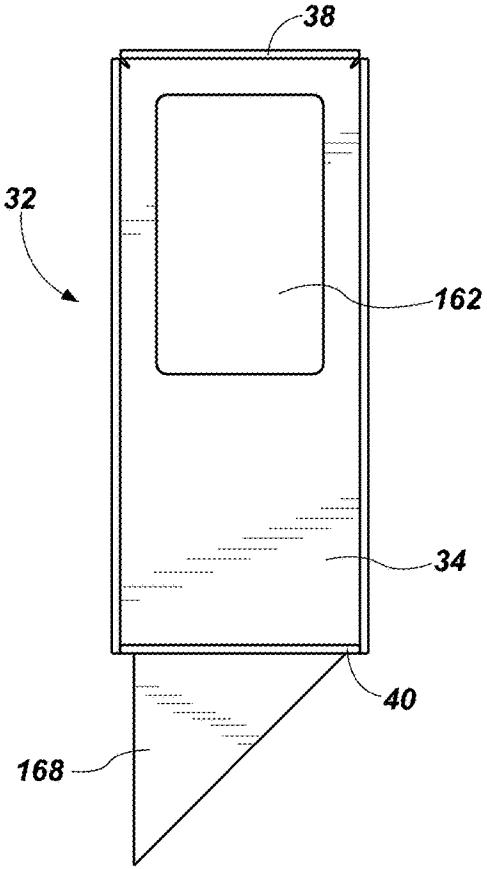
FIG. 40 illustrates a bottom view of the extendable member of FIG. 39.
Figure 41:
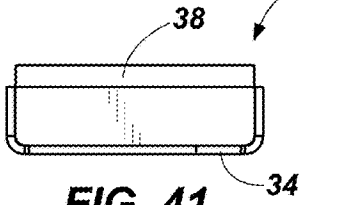
FIG. 41 illustrates a longitudinal side view of the extendable member of FIG. 39.

Referring to FIG. 10, an alternate embodiment of a system 110, is depicted. The system 110 may include a housing 112 that is substantially similar to the housing previously described herein.

The housing 112 may include a first wall 116, which may be substantially planar, extending a length and a width of the housing 112. The first wall 116 may be substantially flat and configured to allow other flat elements (i.e. bricks, blocks, etc.) to easily reside on the first wall 116. The first wall 16 may include bends or curves toward each width end of the first wall 116. A pair of second walls 118, 118' may extend from the first wall 116, or the bends of the first wall 16, in a direction substantially perpendicular to the first wall 116. Extending from the pair of second walls 118, 118' are a pair of third walls 120, 120' that may extend from separate bends in the second walls 118, 118'. The pair of third walls 120, 120' may extend toward each other and the longitudinal axis 114, or midline, of the longitudinal housing 112. A channel 125 may be positioned between the pair of third walls 120, 120' and run the length of the housing 112. The third walls 120, 120' may be substantially parallel to the first wall 116. The channel 125, or passage, or void, may run the length of the housing. A cross-sectional shape of the housing 116 may resemble a C-shape or U-shape.

The housing 112 may include a first opening 124 toward one end of the housing 112 and a second opening 126 toward a second end of the housing 112 with the channel 125 running from the first opening 124 to the second opening 126. A cross-bar 128 may extend from the third walls 120, 120' across the channel 125.

Rather than support members 30, this embodiment may include a pin 130, or rod, which may pass through a pair of holes 152 in the housing through the pair of second walls 118, 118', or side walls. The holes 152 may be axially aligned with one another to allow for easy passage of a pin 130. The pin 130 may at least partially traverse the channel 125 and may traverse the channel 125 entirely.

Similar to the previous extendable members 31, 32 a first extendable member 132 may be substantially rectangular in shape and from one perspective may resemble a tray or open top box. The first extendable member 132 includes a body with a planar first wall 134 that may run substantially parallel to the first wall 116 of the housing. The first extendable member 132 may also comprise a proximal wall 138 and a distal wall 140, opposite each other, and which may be substantially parallel to each other, extending from a first planar wall 134 at a 90° angle and connected to the pair of extendable member second walls 136, 136'.

The proximal wall 138 may extend further from the planar first wall 134 than the distal wall 140. The proximal wall 138 may extend further than the extendable member second walls 136, 136' as well. The proximal wall 138 may provide a stop against the pin 130 (as may be seen in FIGS. 11-14) so that the first extendable member 132 does not extend too far out of the housing 112. The distal wall 140 may include a distal tip 142 which may include a flange 144, or tab, which extends longitudinally from the distal wall 140 in the same plane or parallel plane as the planar first wall 134. The distal tip 142 may be integrated into the body of the first extendable member 132 or may be a separate piece that may be secured, or welded, to the distal wall 140. The distal tip 142 may include a right angle piece, or elbow, that on one plane sits flush against the distal wall 140 and a separate plane, perpendicular to the one plane sitting flush against the distal wall, extending in a same plane, or substantially the same plane, or parallel plane to the first planar wall 134, which may be the flange 144. The flange 144 engages the construction element 50.

A second extendable member 131 may be substantially similar and mirror image of the first extendable member 132 with the same elements and features. Each extendable member 132, 131 may extend from the housing 112 at least as far as half of the length of the extendable members 132, 131. Each extendable member 132, 131 may extend just far enough for the flange 144 to protrude from the housing 112 to engage one edge of an opening (see FIG. 9). Each extendable member 132, 131 may extend as far as required to traverse an opening with the appropriate length of housing 112. The distance each extendable member 132, 131 extends infinite because it can slide to any number of positions from the flange 144 extending until the extendable member 132, 131 is prevented from extending further.

Extendable member 132, 131 may include slots 154, or cutouts, or elongated apertures, within the second walls 136, 136', or side walls. The slots 154 may be elongated holes or apertures extending perpendicular to the second walls 136, 136'. The slots 154 may be axially aligned and may pass through each of the second walls 136, 136' entirely. The slots 154 may allow for passage of the pin 130. The slots 154 may slidably receive the pin 130 so as to allow the elongated member to freely slide into and out of the housing 112. Likewise the holes 152 may slidably receive the pin 130 and may engage the housing as further described herein. The pin 130 may traverse the holes 152 and the slots 154 and the pin 130 secured to the housing 112 with a nut 156 or bolt. Alternatively, the pin 130 may have a transverse aperture that allows for a separate rod to pass through that secures the pin 130 to the housing. The pin 130 may resemble a screw with threads on at least one end that may engage a nut 156 on one side of the housing, such as on second wall 118, with the head of the screw on the opposite side of the housing, such as on second wall 118'. It will be appreciated that any number of methods and means of securing a rod, pin or screw is contemplated herein.

The slots 154, with the pin 130 passing therethrough, provides a maximum and minimum length for extension of the first extendable member 132. A distal end of the slot 158 may be engaged when the first extendable member 132 is retracted into the housing in the first configuration 100. A proximal end of the slot 160 may be engaged when the first extendable member 132 is extended from the housing, in the second configuration 102, at a maximum distance. The slots 154 may allow for an infinite number of positions between the proximal end of the slot 160 and the distal end of the slot 158.

The first extendable member 132 may further include a window 162, or opening, in the planar wall 134. The window 162 may allow for the first extendable member 132 to be manufactured with less weight for easier use and manipulation. The window 162 may also provide a user with the ability to see through the first extendable member 132 to see the traversed opening and the housing 112.

For ease in describing the system 110 the first extendable member 132 may have been utilized but it will be appreciated that the second extendable member 131 may comprise the same features and elements and may be a mirror image of the first extendable member 132 when positioned in the housing 112.

Referring to FIGS. 11-18, a system 210 is depicted with the housing 112 may be that as previously described herein. However, the extendable members 31, 32 may be substantially as previously described herein with the addition of the window 162. Rather than the system 10 comprising support members 30, this system 210 embodiment utilizes the same holes 152 and pin 130 wherein from the previous embodiment 110 wherein the pin 130 may act similarly as the support members 30 maintaining the extendable members 31, 32 in place as well as the pin 130 engaging with the proximal wall 38 to act as a stop, as similarly previously described.

In this embodiment the pin 130 may provide the same strength and stability as the support members 30 but with far less weight allowing for easier manipulation of the system 110 or system 210.

Referring to FIGS. 19-22, the extendable member 132 may comprise an alternate flange that may comprise an angle. A flange 164 may comprise the same elements as the previously disclosed embodiment of a flange 144. The flange 164 may include an angle of 11° and may utilize such an angle to allow a user (which may be a mason) to stabilize the system across an opening that may have an angled wall or an intersection of two wells that is angled. By providing an angled flange 164 the entire flange me rest on the angled wall with no exposure of the flange 164.

Referring to FIGS. 23-26, the extendable member 132 may comprise an alternate flange that may comprise an angle. A flange 166 may comprise the same elements as the previously disclosed embodiment of a flange 144. The flange 166 may include an angle of 22° and may utilize such an angle to allow a user (which may be a mason) to stabilize the system across an opening that may have an angled wall or an intersection of two wells that is angled. By providing an angled flange 166 the entire flange me rest on the angled wall with no exposure of the flange 166.

Referring to FIGS. 27-30, the extendable member 132 may comprise an alternate flange that may comprise an angle. A flange 168 may comprise the same elements as the previously disclosed embodiment of a flange 144. The flange 168 may include an angle of 45° and may utilize such an angle to allow a user (which may be a mason) to stabilize the system across an opening that may have an angled wall or an intersection of two wells that is angled. By providing an angled flange 168 the entire flange me rest on the angled wall with no exposure of the flange 168.

It will be appreciated that any number of angles is contemplated here and specifically between 5° to 45° and the above examples are simply examples and not limiting herein.

Referring to FIGS. 31-42 similar examples of angled flanges are provided utilizing the extendable members 32 described in the first embodiment of the system 10 with the exception of the window 162 also contemplated herein. Similar angles to the previous embodiments are shown with angles of 11°, 22° and 45° respectively. These embodiments may not include the slots 154 as these embodiments may be intended for use with the alternate system 210 but may also be utilized in the first described system 10.

The dimensions of the system may vary as well. The housing 12 may be anywhere from 2 feet (or roughly 0.6 meters) to 42 feet (or roughly 13 meters) in length. The width of the housing 12 may be 4 to 8 inches (or roughly 10 cm to 21 cm). The height of the housing 12 may be 2 to 4 inches (or roughly 5 cm to 11 cm). The length of the extendable members 31, 32, may vary but may be in the range of 12 to 18 inches (or roughly 30 cm to 46 cm), with the extendable members 31, 32 being capable of extending 6 to 9 inches (or roughly 15 cm to 23 cm).

A user may then use building materials, bricks, blocks, etc., to build across and on top of the system 10 utilizing the system 10 to stabilize the materials. The user may then remove the system 10 by simply retracting the extendable members 31, 32 at least enough to release the flange(s) from the edges of the construction element 50 opening.

It will be appreciated that the housing 12, 112, or shell, may be comprised of 12-14 Gauge C Channel purlin which is a commonly used beam to extend over a roof or other constructive element. The extendable members 31, 32, 131, 132 (or trays) may be one-quarter inch milled steel (it may also be cast, forged, extruded, welded, etc.). The pin 130, or rod, may be comprised of steel, other metal or metal alloys that provide the strength and rigidity necessary for the functions described herein. Other metals and materials may be used with a similar construct and even wood, plastics and carbon-fiber are contemplated.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

What is claimed:

1. A system for traversing an opening, comprising: an elongated frame comprising:

a first planar surface; a pair of longitudinal walls extending substantially perpendicular from the first planar surface forming a channel;

a first extendable member configured to extend longitudinally beyond the frame, the first extendable member comprising:

a second planar surface substantially parallel to the first planar surface;

a first lateral wall extending substantially perpendicular to the second planar surface and a second lateral wall opposite the first lateral wall extending substantially perpendicular to the second planar surface;

a distal wall substantially perpendicular to the first and second lateral walls, a proximal wall substantially parallel and opposite the distal wall, wherein the proximal wall is longer than the distal wall and lateral walls;

a flange extending longitudinal and in the same plane as the second planar surface; and a pair of elongated slots extending parallel to the first lateral wall and second lateral wall, wherein the first extendable member is configured to freely slide longitudinally along the elongated slots; and the first rod extending between and fixed to the pair of longitudinal walls, the first rod traversing the channel; and the first rod passing through the pair of elongated slots of the first extendable member.

2. The system of claim 1 comprising;

a second rod; and a second extendable member, opposite the first extendable member, configured to extend longitudinally beyond the frame in a direction opposite the first extendable member, the second extendable member comprising:

a third planar surface extending in the same plane as the second planar surface; and a flange extending longitudinal and in the same plane as the third planar surface.

3. The system of claim 2 comprising:

a first configuration wherein the first and second extendable members are positioned within the frame; and a second configuration wherein the first and second extendable members are extended at least partially outside the frame.

4. The system of claim 1, wherein the channel extends across the width between the pair of longitudinal walls; wherein the pair of longitudinal walls comprises:

a first wall with a first hole; and a second wall with a second hole axially aligned with the first hole.

5. The system of claim 4, wherein the rod passes at least partially through the first hole and the second hole and is secured to the frame.

6. The system of claim 1, wherein the frame comprises a first opening and a second opening opposite the first opening, wherein the channel extends longitudinally from the first opening to the second opening.

7. The system of claim 1, wherein the frame comprises a pair of longitudinal lips extending substantially perpendicular from the pair of longitudinal walls and toward the center or midline of the frame.

8. The system of claim 1 wherein the first extendable member further comprises:

a plurality of walls extending substantially perpendicular to the second planar surface wherein the first extendable member resembles a tray.

9. The system of claim 1, wherein the pair of elongated slots are configured to guide the first extendable member to an extended position and to a retracted position.

10. A system for traversing an opening, comprising:

an elongated housing comprising:

a first planar surface;

a pair of longitudinal walls extending substantially perpendicular from the first planar surface forming a channel;

a first slide configured to extend longitudinally beyond the frame, the first slide comprising:

a second planar surface substantially parallel to the first planar surface, a flange extending longitudinal and in the same plane as the second planar surface;

a first lateral wall extending substantially perpendicular to the second planar surface and a second lateral wall opposite the first lateral wall extending substantially perpendicular to the second planar surface;

a distal wall substantially perpendicular to the first and second lateral walls;

a proximal wall substantially parallel and opposite the distal wall, wherein the proximal wall is longer than the distal wall and lateral walls, wherein the proximal wall engages at least one pin to stop the first extendable member at a predetermined distance, and the at least one pin extending between the pair of longitudinal walls, the at least one pin traversing the channel; and a second slide, opposite the first slide, configured to extend longitudinally beyond the frame in a direction opposite the first slide, the second slide comprising:

a third planar surface extending in the same plane as the second planar surface; and a flange extending longitudinal and in the same plane as the third planar surface.

11. The system of claim 10, wherein the pin engages the housing, the first slide and the second slide.

12. The system of claim 10 comprising: a first configuration wherein the first and second slides are positioned within the housing; and a second configuration wherein the first and second slides are extended at least partially outside the housing.

13. The system of claim 10, wherein the channel extends across the width between the pair of longitudinal walls; wherein the pair of longitudinal walls comprises:

a first wall with a first hole; and a second wall with a second hole axially aligned with the first hole.

14. The system of claim 13, wherein the pin passes at least partially through the first hole and the second hole and is secured to the housing.

15. The system of claim 10, wherein the housing comprises a first opening and a second opening opposite the first opening, wherein the channel extends longitudinally from the first opening to the second opening.

16. The system of claim 10 wherein the first slide further comprises:

a plurality of walls extending substantially perpendicular to the second planar surface wherein the first slide resembles a tray.

17. The system of claim 3, wherein the pair of elongated slots allow the first extendable member to slide freely between the first configuration and second configuration.

18. The system of claim 12; wherein the pair of elongated apertures allow the first extendable member to slide freely between the first configuration and second configuration.

19. A system for traversing an opening, comprising:

an elongated housing comprising:

a first planar surface;

a pair of longitudinal walls extending substantially perpendicular from the first planar surface forming a channel;

a first slide configured to extend longitudinally beyond the frame, the first slide comprising:

a second planar surface substantially parallel to the first planar surface, wherein an opening extends through the second planar surface;

a flange extending longitudinal and in the same plane as the second planar surface, wherein the flange of the first slide extends further from either one of the first lateral wall or second lateral wall than the other of either the first lateral wall or second lateral wall, thus forming an angled flange;

a first lateral wall extending substantially perpendicular to the second planar surface and a second lateral wall opposite the first lateral wall extending substantially perpendicular to the second planar surface; and a pair of elongated apertures extending non-parallel to the first lateral wall and second lateral wall, wherein a first extendable member is configured to freely slide longitudinally along the elongated apertures;

at least one pin extending between the pair of longitudinal walls and through the pair of elongated apertures, the pin traversing the channel; and a second slide, opposite the first slide, configured to extend longitudinally beyond the frame in a direction opposite the first slide, the second slide comprising:

a third planar surface extending in the same plane as the second planar surface; and a flange extending longitudinal and in the same plane as the third planar surface.

* * * * *